US006260401B1

(12) United States Patent
Tada

(10) Patent No.: US 6,260,401 B1
(45) Date of Patent: Jul. 17, 2001

(54) METHOD OF MOLDING HIGH EXPANSION PIPE AND THE HIGH EXPANSION PIPE

(75) Inventor: Minoru Tada, Mie (JP)

(73) Assignee: Bestex Kyoei Co., Ltd., Mie (JP)

( * ) Notice: Subject to any disclaimer, the term of this patent is extended or adjusted under 35 U.S.C. 154(b) by 0 days.

(21) Appl. No.: 09/367,406

(22) PCT Filed: Dec. 9, 1998

(86) PCT No.: PCT/JP98/05560

§ 371 Date: Oct. 25, 1999

§ 102(e) Date: Oct. 25, 1999

(87) PCT Pub. No.: WO99/30852

PCT Pub. Date: Jun. 24, 1999

(30) Foreign Application Priority Data

Dec. 15, 1997 (JP) ..... 9-345017

(51) Int. Cl.[7] ..... B21D 41/02

(52) U.S. Cl. ..... 72/370.06; 72/318

(58) Field of Search ..... 72/318, 370.01, 72/370.06, 370.08, 370.1, 370.23; 29/890.053

(56) References Cited

U.S. PATENT DOCUMENTS 2,506,657 * 5/1950 Webster ..... 72/109
2,739,376 * 3/1956 Peet ..... 72/370.06
4,450,329 5/1984 Arimoto et al. .
4,732,030 * 3/1988 Tanaka ..... 72/370.06
4,901,557 * 2/1990 Schmidt ..... 72/370.08

FOREIGN PATENT DOCUMENTS 49-65974 6/1974 (JP) .
54-52664 4/1979 (JP) .
57-39049 3/1982 (JP) .

* cited by examiner

*Primary Examiner*—Lowell A. Larson
(74) *Attorney, Agent, or Firm*—Merchant & Gould P.C.

(57) ABSTRACT

When a flaring punch 2 is pressed into a pipe P from an end thereof to form a concentric or eccentric flared portion Pa, the taper angle θ of the flaring punch is adjusted to apply axial compressive forces to the flared portion Pa thereby to maintain the wall thickness of the flared portion Pa at 70% or greater of the wall thickness of the blank pipe. If the flared portion is formed by a plurality of flaring punches 2A, 2B, 2C having different maximum diameters at a plurality stages, then regions where the elongation is maximum are not localized, preventing the wall thickness from being locally reduced. If an eccentric highly flared pipe where the center of the flared portion Pa and the center of the pipe P are displaced from each other is formed, then a seam-welded region s of the pipe P is aligned with the direction in which the amount ϵ of eccentricity is maximum, making the flared pipe resistant to being ruptured.

16 Claims, 8 Drawing Sheets

FIG. 5B
SEAM-WELDED REGION
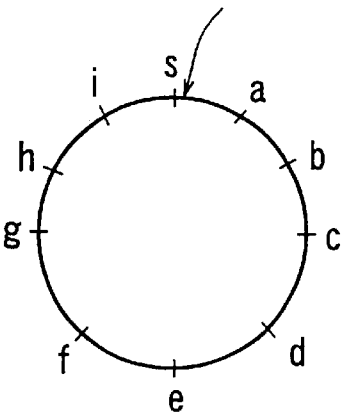
FIG. 5A
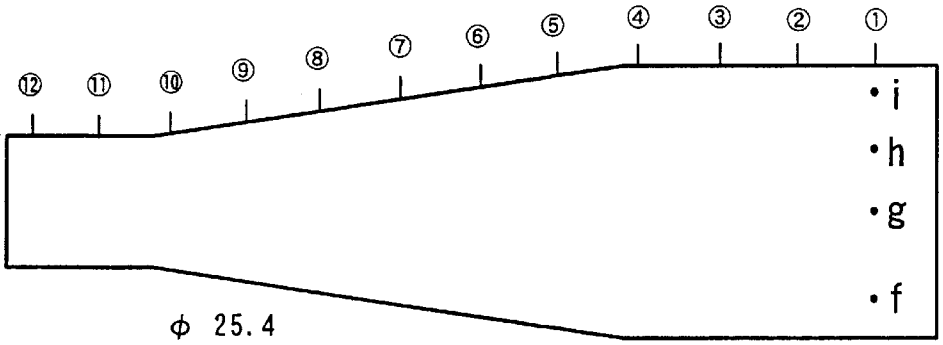
φ 25.4
t 1.0
FIG. 5C
MEASURED WALL THICKNESSES
| ① | ② | ③ | ④ | ⑤ | ⑥ | ⑦ | ⑧ | ⑨ | ⑩ | ⑪ | ⑫ |
|---|---|---|---|---|---|---|---|---|---|---|---|
| 0.766 | 0.809 | 0.878 | 0.892 | 0.880 | 0.895 | 0.907 | 0.909 | 0.920 | 0.948 | 0.985 | 0.994 |
| a | b | c | d | e | f | g | h | i | | | |
| 0.768 | 0.767 | 0.845 | 0.821 | 0.809 | 0.819 | 0.840 | 0.774 | 0.852 | | | |

FIG. 7A
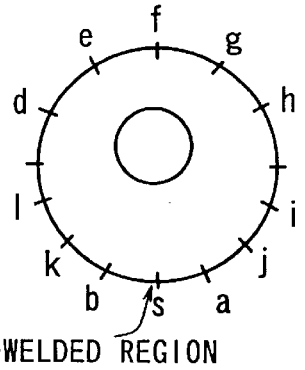
FIG. 7B
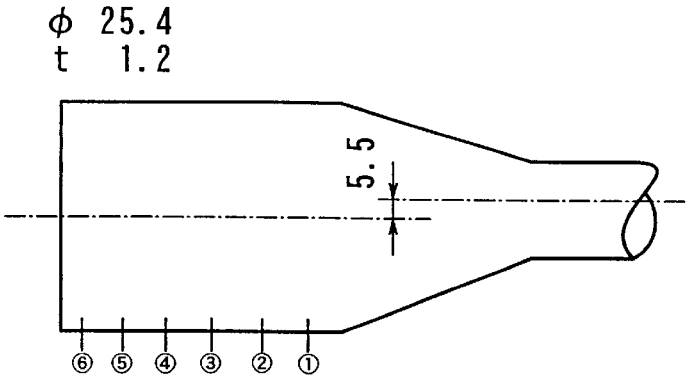
FIG. 7C
MEASURED WALL THICKNESSES
| | ① | ② | ③ | ④ | ⑤ | ⑥ |
|---|---|---|---|---|---|---|
| a | 0.998 | 0.998 | 0.982 | 0.995 | 1.047 | 1.029 |
| b | 0.950 | 0.939 | 0.940 | 0.935 | 0.929 | 0.930 |
| s | 1.114 | 1.132 | 1.119 | 1.125 | 1.129 | 1.125 |
| d | | | | | 1.046 | |
| e | | | | | 1.054 | |
| f | | | | | 0.894 | |
| g | | | | | 0.957 | |
| h | | | | | 0.995 | |
| i | | | | | 0.930 | |
| j | | | | | 0.957 | |
| k | | | | | 0.956 | |
| l | | | | | 0.954 | |

FIG. 8A
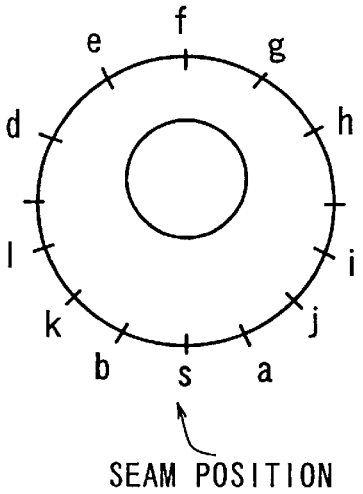
FIG. 8B
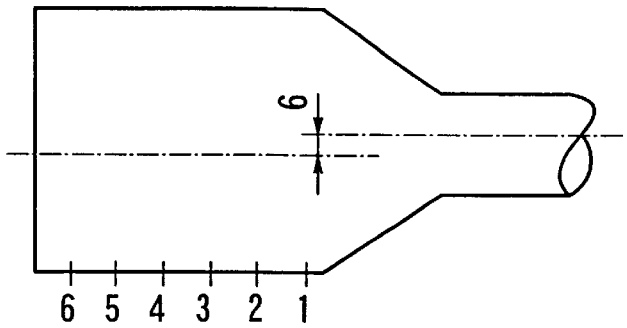
FIG. 8C
WALL THICKNESS DATA PRODUCED WHEN PIPE HAVING DIAMETER OF 28.6mm AND WALL THICKNESS OF 1.2mm WAS MACHINED
| | 1 | 2 | 3 | 4 | 5 | 6 |
|---|---|---|---|---|---|---|
| a | 1.018 | 1.018 | 1.002 | 1.015 | 1.068 | 1.050 |
| b | 0.969 | 0.958 | 0.959 | 0.954 | 0.948 | 0.949 |
| s | 1.136 | 1.155 | 1.141 | 1.148 | 1.152 | 1.148 |
| d | | | | | 1.067 | |
| e | | | | | 1.075 | |
| f | | | | | 0.912 | |
| g | | | | | 0.976 | |
| h | | | | | 1.015 | |
| i | | | | | 0.949 | |
| j | | | | | 0.976 | |
| k | | | | | 0.975 | |
| l | | | | | 0.973 | |

METHOD OF MOLDING HIGH EXPANSION PIPE AND THE HIGH EXPANSION PIPE

TECHNICAL FIELD

The present invention relates to a method of forming a highly flared portion on an end of a pipe, which is of a diameter about twice the diameter of the blank pipe, and a highly flared pipe.

BACKGROUND ART

Heretofore, it has been attempted to flare an end of a pipe, e.g., a beam member or a frame member in the form of a metallic pipe as a vehicular indoor component or the like, for increasing the mounting strength of the pipe. According to one known machining process for flaring a pipe end, the outer circumferential surface of a blank pipe is clamped in place by clamp dies and a tapered flaring punch is pressed into an end of the pipe hole thereby to flare the pipe end.

When the flaring punch is pressed into the pipe end to flare the same according to the above machining process, the flared pipe end is elongated with a resultant reduction in its thickness. When the elongation limit of the pipe material is reached, the pipe starts being ruptured from the flared end. Ordinary steel pipes can be flared up to diameters that are about 1.4 times those of blank pipes, and cannot further be machined beyond that limit.

When the flaring punch is pressed into an end of a blank pipe, the centers of the blank pipe and the flaring punch may be positioned out of alignment with each other for thereby producing a pipe with an eccentric flared end. According to this process, the produced pipe includes a region which is more elongated than a pipe with a concentric flared end depending on the amount of eccentricity, resulting in large thickness variations of the pipe. Generally, it is more difficult to produce pipes with eccentric flared ends than pipes with concentric flared ends.

FIG. 11 shows measured thicknesses of a pipe with an eccentric flared end which has been machined from a blank pipe having a wall thickness of 1 mm according to the conventional process. The measured thicknesses indicate that the thickness of a pipe region where the wall thickness is reduced to a maximum, among regions in circumferential and axial directions, is reduced to about 50% of the wall thickness of the blank pipe.

Pipes with concentric flared ends and pipes with eccentric flared ends are employed in different spots in vehicles, and some flared ends are attached to vehicle bodies and parts are mounted on other flared ends. Since pipes with ends flared to diameters that are about 1.4 times those of blank pipes suffer insufficient mechanical strength and generally have reduced thickness, they need to be reinforced by separate stiffeners. However, if those pipes are incorporated in vehicles, then use of the stiffeners is disadvantageous because they increase the weight of the vehicles.

DISCLOSURE OF THE INVENTION

The present invention has been made in an effort to solve the above problems. It is an object of the present invention to provide a machining technique of flaring at least an end of a pipe to produce a concentric or eccentric flared end which is of a diameter about twice the diameter of a blank pipe without rupturing the end, and a highly flared pipe.

To achieve the above object, there is provided in accordance with the present invention, as defined in claim 1, a method of forming a highly flared pipe by pressing a flaring punch into a pipe from its hole to form a concentric or eccentric flared portion, characterized by the steps of applying axial compressive forces to the pipe material where the flaring punch is pressed in to allow the flared portion to maintain a wall thickness which is at least 70% of the wall thickness of the blank pipe and to have a diameter which is about twice the diameter of the blank pipe.

Specifically, the pipe is flared while compressive forces are being applied axially (in the direction in which the flaring punch is pressed) to the pipe material where the flaring punch is pressed in to allow the flared portion to maintain a wall thickness which is at least 70% of the wall thickness of the blank pipe. Even if the pipe is flared to a diameter which is about twice the diameter of the blank pipe, the pipe is prevented from being ruptured or otherwise damaged at the end.

According to the present invention, the compressive forces applied axially to the pipe material where the flaring punch is pressed in are adjusted by adjusting the taper angle of the flaring punch.

If the taper angle were excessively large, then only tensile forces would be radially applied to the pipe material where the flaring punch is pressed in, and axial compressive forces would not effectively be applied thereto. If the taper angle were excessively small, then, similarly, compressive forces would not effectively be applied to the pipe material where the flaring punch is pressed in, and the efficiency with which to form the flared portion would be low.

If the taper angle is appropriately established, then the pipe portion where the flaring punch is pressed in can maintain a wall thickness which is at least 70% of the wall thickness of the blank pipe. Thus, even if the pipe is flared to a diameter which is about twice the diameter of the blank pipe, the pipe is prevented from being ruptured or otherwise damaged.

According to the present invention, furthermore, the flared portion is formed by pressing flaring punches having different maximum diameters in a plurality of stages.

When the flaring punches having the different maximum diameters are pressed in the plural stages, pipe regions where the elongation of the pipe material is maximum are axially distributed, but prevented from being localized in a certain area.

Those flaring punches have the same taper angle.

If the pipe is a seam-welded pipe and the flared portion is eccentric, then a seam-welded region is aligned with the direction in which the amount of eccentricity is maximum.

With the eccentric highly flared pipe, the direction in which the amount of eccentricity is maximum represents a region where the tensile forces are maximum and the material elongation is largest. With the seam-welded pipe, the seam-welded region is harder than other regions of the pipe. Consequently, the seam-welded region is aligned with the region where the maximum tensile forces are imposed, for thereby preventing that region from being ruptured.

According to the present invention, moreover, a highly flared pipe has a flared portion having a diameter which is about twice the diameter of a blank pipe, produced by pressing a flaring punch into the blank pipe from its hole, the flared portion having a wall thickness which is at least 70% of the wall thickness of the blank pipe. According to claim 6, if the pipe is a seam-welded pipe, then a seam-welded region is aligned with the direction in which the amount of eccentricity is maximum.

The above highly flared pipe can be produced by the above forming method.

According to the present invention, furthermore, the end of the flared portion is flanged.

If the end of the flared portion is flanged, then it can be used as a mounting member of increased rigidity.

BRIEF DESCRIPTION OF THE DRAWINGS

FIG. 5 is a diagram showing measured thicknesses of a pipe with a concentric highly flared end;

FIG. 7 is a diagram showing measured thicknesses of a pipe with an eccentric highly flared end;

FIG. 8 is a diagram showing measured thicknesses of a pipe with an eccentric highly flared end according to another embodiment;

Denoted in FIGS. 2, 2A, 2B, 2C are flaring punches, P a pipe, Pa a flared portion, θ a taper angle, ϵ an amount of eccentricity, and s a seam-welded region.

BEST MODE FOR CARRYING OUT THE INVENTION

Embodiments of the present invention will be described below with reference to the accompanying drawings.

Figure 1:
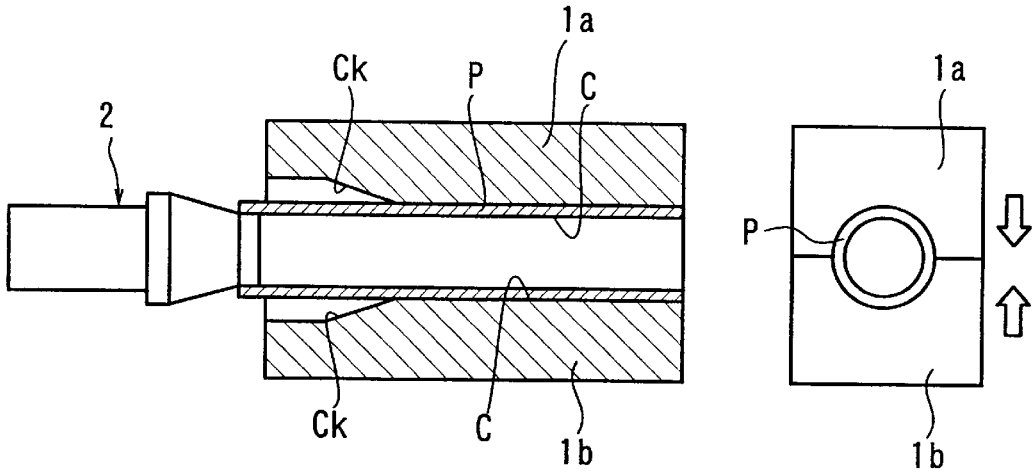
FIG. 1 is a view illustrative of the general practice to form a pipe with a flared end.
Figure 2:
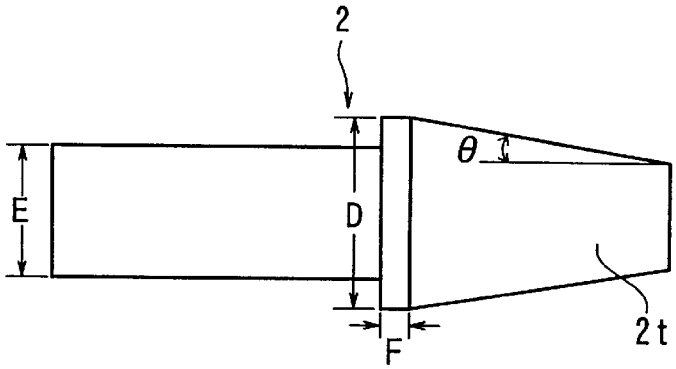
FIG. 2 is a view of a flaring punch.
Figure 3A:
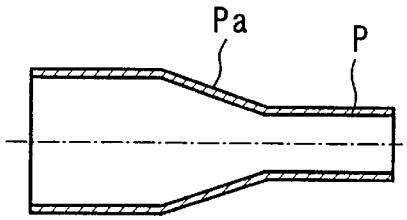
FIGS. 3(A) and 3(B) are views showing a pipe with a concentric highly flared end and a pipe with an eccentric highly flared end, respectively.
Figure 3B:
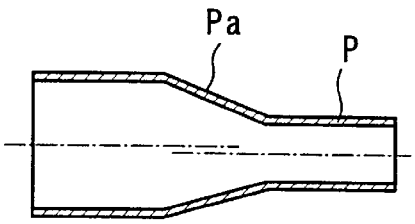

FIG. 1 is a view illustrative of the general practice to form a pipe with a flared end, FIG. 2 is a view of a flaring punch, FIG. 3 is a view illustrative of pipes with highly flared ends, and FIG. 4 is a view illustrative of three stages of producing a pipe with a concentric highly flared end.

A pipe with a flared end according to the present invention is produced by using, as shown in FIG. 1, a pair of clamp dies 1*a*, 1*b* and a flaring punch 2. Specifically, the outer circumferential surface of a pipe P is clamped in place by being sandwiched by semicylindrical grooves C in the clamp dies 1*a*, 1*b*, and thereafter the flaring punch 2 having a tapered tip end is pressed into the pipe P from its hole at the distal end thereof to form a flared portion Pa (FIGS. 3(A) and 3(B)) on the end of the pipe P.

The semicylindrical grooves C in the clamp dies 1*a*, 1*b* have respective outer circumferential surface constricting portions Ck spreading outwardly in a tapered configuration.

As shown in FIG. 2, the flaring punch 2 has a presser 2*t* tapered toward its distal end at a taper angle θ which is substantially the same as the taper angle of the outer circumferential surface constricting portions Ck.

The taper angle θ of the flaring punch 2 and the taper angle of the outer circumferential surface constricting portions Ck of the clamp dies 1*a*, 1*b* are about 7 degrees that are smaller than the taper angles of conventional general flaring punches and clamp dies. The diameter of the distal end of the flaring punch 2 is substantially the same as the inside diameter of the pipe P. The maximum diameter D of the flaring punch 2 is the same as the inside diameter of a flared pipe. The flaring punch 2 has a diameter E at its proximal end which is smaller than the maximum diameter D to prevent an increase in the resistance to the flaring punch 2 when the flaring punch 2 is pressed into the pipe P. The portion of the flaring punch 2 which has the maximum diameter D has a length F ranging from 2 to 5 mm.

The taper angle θ of the flaring punch 2 and the taper angle of the outer circumferential surface constricting portions Ck of the clamp dies 1*a*, 1*b*, both of which are about 7 degrees, were determined by the inventor through experiments in order to apply compressive forces to the flared portion Pa in the axial direction (the direction in which the flaring punch 2 is pressed) to prevent the pipe end from being ruptured due to wall thickness variations when the flaring punch 2 is pressed into the pipe P from the hole in its distal end to form the flared portion Pa. If the taper angles were greater than the above value, then excessive radial forces would be applied to the flared portion Pa when the flaring punch 2 is forced into the pipe P, causing the pipe P to start being ruptured before the diameter of the pipe P increases to a diameter about twice the diameter of the blank pipe. If the taper angles were smaller than the above value, then no effective compressive forces would be applied to the flared portion Pa, and the efficiency with which to form the flared portion Pa would be low.

In the embodiment, the diameter of the flared portion Pa is about twice the diameter of the blank pipe. Therefore, if a concentric highly flared pipe is to be produced, then the blank pipe is machined in three stages as shown in FIG. 4, and if an eccentric highly flared pipe is to be produced, then the blank pipe is machined in four stages.

Figure 4A:
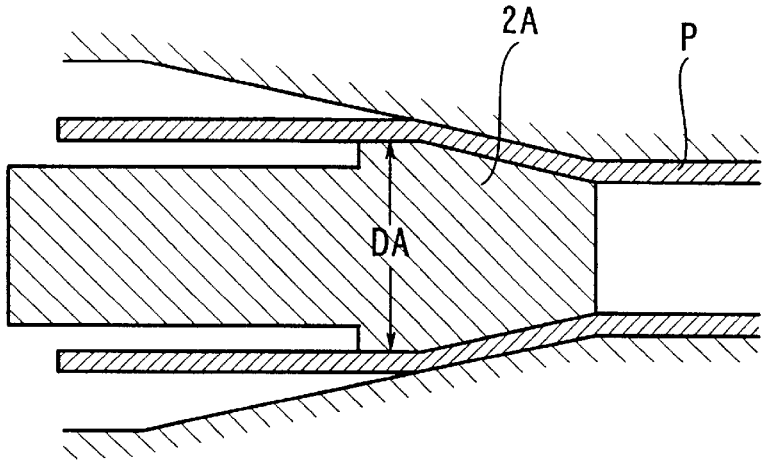
FIGS. 4(A), 4(B), and 4(C) are views illustrative of three stages of producing a pipe with a concentric highly flared end.
Figure 4B:
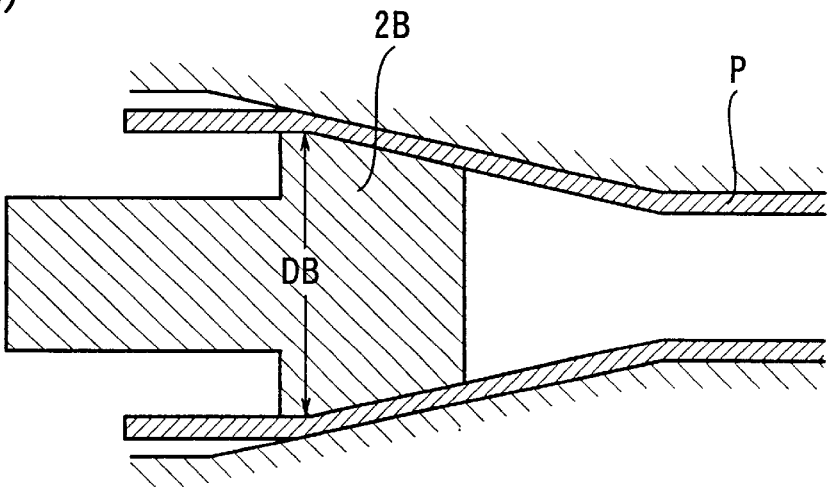
Figure 4C:
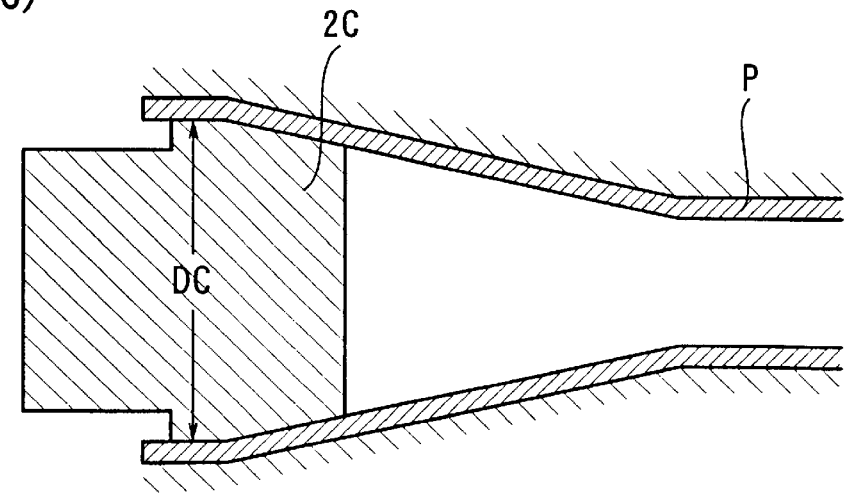

Specifically, as shown in FIGS. 4(A)–4(C), a flaring punch 2A used in the first stage (see FIG. 4(A)) has a maximum diameter DA which is 1.4 times the diameter d of the blank pipe, a flaring punch 2B used in the second stage (see FIG. 4(B)) has a maximum diameter DB which is 1.2 times the diameter DA, and a flaring punch 2C used in the third stage (see FIG. 4(C)) has a maximum diameter DC which is 1.2 times the diameter DB.

The flaring punches 2A, 2B, 2C have the same taper angle θ of about 7 degrees. When the flaring punches 2A, 2B, 2C having the different maximum diameters are successively pressed into the pipe P, pipe regions where the elongation is maximum are axially distributed, but prevented from being localized in a certain area, so that the wall thickness of such a local area will not be greatly reduced.

FIG. 5 shows measured wall thicknesses mainly around a flared portion Pa of a concentric highly flared pipe, whose diameter was about twice the diameter of the blank pipe, produced from a pipe P having a diameter of 25.4 mm and a wall thickness of 1 mm according to the above process. As a result, it was confirmed that of wall thickness variations in the circumferential and axial directions of the flared portion Pa, the maximum wall thickness variation represented a wall thickness of 0.766 mm near the end, and the thicknesses of all measured spots were at least 76% of the wall thickness of the blank pipe.

Figure 6A:
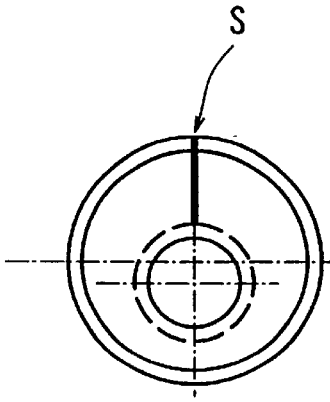
FIG. 6 is a view illustrative of a seam-welded region at the time a seam-welded pipe is machined into a pipe with an eccentric highly flared end.
Figure 6B:
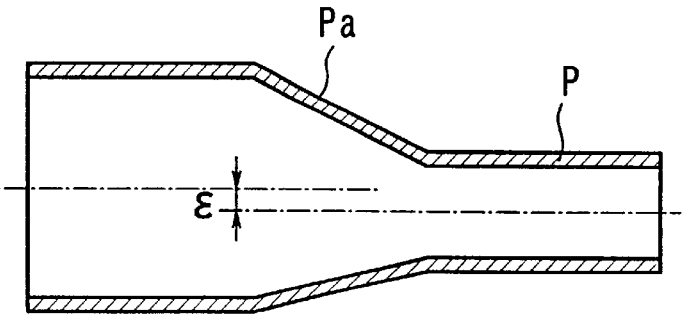

If an eccentric highly flared pipe with a flared portion whose diameter is about twice the diameter of the blank pipe is produced, then, as shown in FIG. 6, the flared pipe has a region whose elongation is greater than the concentric highly flared pipe and a region whose elongation is smaller than the concentric highly flared pipe, with the elongation being maximum in a direction in which the amount $\epsilon$ of eccentricity is maximum.

According to the present invention, when a seam-welded pipe is produced, a seam-welded region s is aligned with the direction in which the amount $\epsilon$ of eccentricity is maximum (the direction in which the elongation is maximum).

In the embodiment, for producing an eccentric highly flared pipe, flaring punches 2A, 2B, 2C, 2D (not shown) having different maximum diameters are successively pressed into the pipe P in four stages.

Specifically, the flaring punch 2A used in the first stage has a maximum diameter DA which is 1.4 times the diameter d of the blank pipe, and the flaring punch 2B used in the second stage has a maximum diameter DB which is 1.11 times the diameter DA. These flaring punches in the first and second stages have a taper angle of 7 degrees for concentrically flaring the pipe. The flaring punch 2C used in the third stage has a maximum diameter DC which is 1.16 times the diameter DB, and the flaring punch 2D used in the fourth stage has a maximum diameter DD which is 1.137 times the diameter DC. These flaring punches in the third and fourth stages have an amount of eccentricity of 5.5 mm for flaring the pipe.

FIG. 7 shows measured wall thicknesses of an eccentric highly flared pipe having a flared portion Pa whose amount of eccentricity was 5.5 mm and whose diameter was about twice the diameter of the blank pipe, produced from a pipe P having a diameter of 25.4 mm and a wall thickness of 1.2 mm according to the above process. As a result, a minimum wall thickness in the circumferential and axial directions was 0.894 mm representing a maximum variation of 74% with respect to the original wall thickness.

FIG. 8 shows measured wall thicknesses of an eccentric highly flared pipe having a flared portion Pa whose amount of eccentricity was 6 mm and whose diameter was about twice the diameter of the blank pipe, produced from a pipe P having a diameter of 28.6 mm and a wall thickness of 1.2 mm according to the above process. As a result, a minimum wall thickness in the circumferential and axial directions was 0.948 mm representing a maximum variation of 79% with respect to the original wall thickness.

Eccentric highly flared pipes having flared portions Pa whose amounts of eccentricity ranged from 2 to 7 mm and whose diameter was about twice the diameter of the blank pipes were produced and subjected to experiments. Any of these eccentric highly flared pipes had a wall thickness of at least 72% with respect to the original wall thickness.

Figure 9:
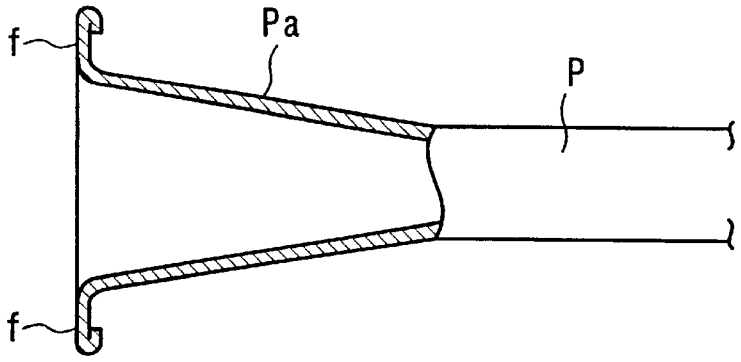
FIG. 9 is a view of a pipe with a flared end on which a flange is formed.

As shown in FIG. 9, the end of the flared portions Pa of each of the above concentric and eccentric highly flared pipes may be machined into a flange f. The flange f is effective to further increase the mounting strength of the flared pipe.

Figure 10A:
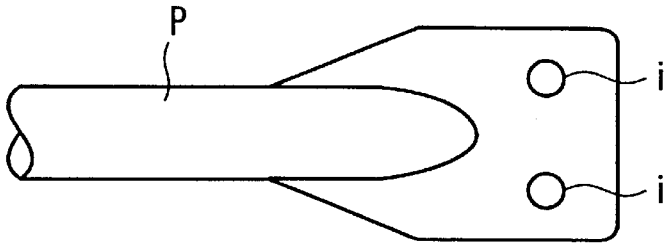
FIGS. 10(A) and 10(B) are views showing applications of a pipe with a flared end.
Figure 10B:
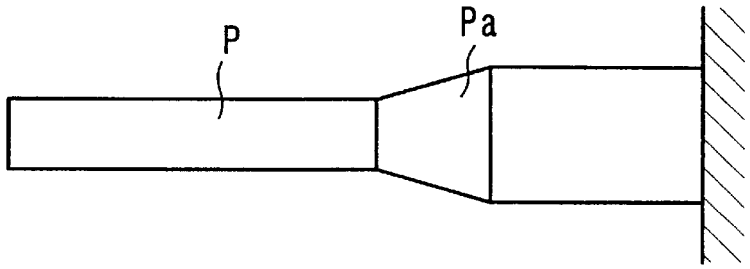
Figure 11A:
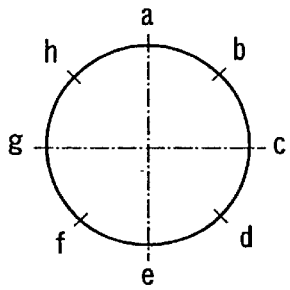
FIG. 11 is a diagram showing measured thicknesses of a pipe with a flared end.
Figure 11B:
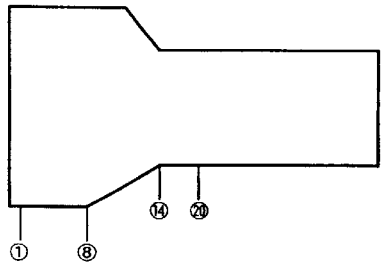
Figure 11C:
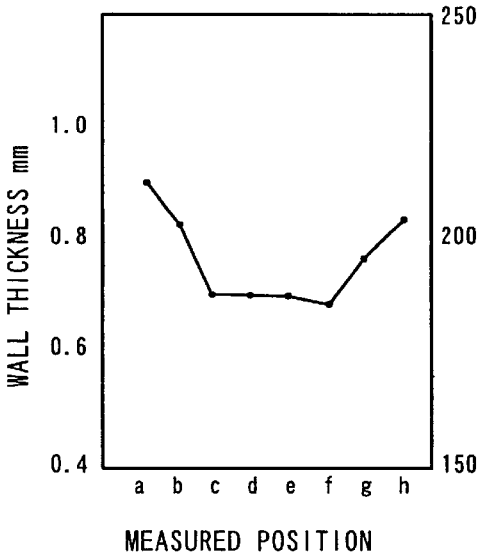
Figure 11D:
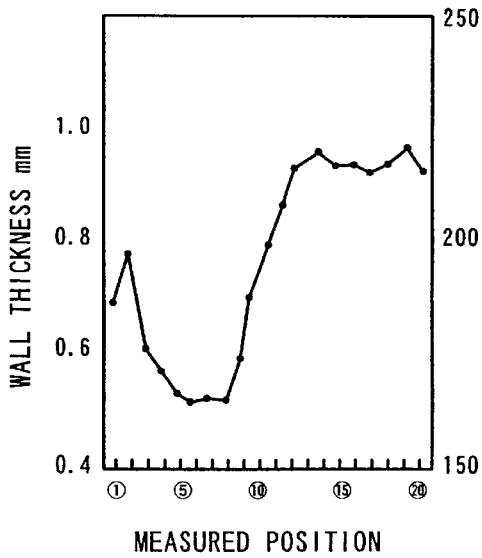

The concentric and eccentric highly flared pipes may be further machined. For example, as shown in FIG. 10A, after a distal end of a pipe is flared, it may be flattened into a closely united end which may be provided fastening holes i spaced from each other by an increased pitch for better mechanical strength. As shown in FIG. 10B, a flared pipe may be used as a structural member of a beam, which has better mechanical strength because the cross-sectional area of the flared pipe is about four times the cross-sectional area of the blank pipe.

If a highly flared pipe according to the present invention is used as a door beam, a steering hanger beam, etc. of a vehicle, then a bracket or the like of a fastening region thereof can be dispensed with. Furthermore, because the diameter of the flared pipe is large, it is possible to increase the pitch between fastening holes when the flared end is flattened into a closely united end. If a highly flared pipe is used as a pipe for supplying fuel, then since the pipe can be integral in its entirety, the pipe can be reduced in weight.

The present invention is not limited to the above embodiment. Any arrangements which have substantially the same structure, operation, and advantages as those described in the scope of claims for patent belong to the technical range of the present invention.

According to the present invention, as described above, when a flaring punch is pressed into a pipe from its hole to form a concentric or eccentric flared portion, compressive forces are applied axially to the pipe material where the flaring punch is pressed in to allow the flared portion to maintain a wall thickness which is at least 70% of the wall thickness of the blank pipe and to have a diameter which is about twice the diameter of the blank pipe, for thereby producing a highly flared pipe. Therefore, the pipe is prevented from suffering problems such as rupture while it is being flared, resulting in a highly flared pipe having high mechanical strength.

According to the present invention, furthermore, the compressive forces are applied axially to the pipe material where the flaring punch is pressed in may be adjusted by adjusting the taper angle of the flaring punch, so that the pipe can easily be shaped simply by pressing the flaring punch.

According to the present invention, furthermore, when flaring punches having different maximum diameters are pressed in a plurality of stages to form a flared portion, pipe regions where the elongation is maximum are prevented from being localized in a certain area.

According to the present invention, furthermore, if the pipe is a seam-welded pipe and the flared portion is eccentric, then a seam-welded region may be aligned with the direction in which the amount of eccentricity is maximum, for producing an eccentric highly flared pipe. In this manner, the pipe can efficiently be flared while preventing itself from being ruptured or otherwise damaged.

According to the present invention, moreover, if the end of the flared portion is flanged, then it can be used as a mounting member of increased rigidity.

INDUSTRIAL APPLICABILITY

A method of forming a highly flared pipe and a highly flared pipe according to the present invention can be applied to beam members or frame members of automobiles.

What is claimed is:

1. A method of forming a highly flared portion in a pipe, comprising the steps of:

pressing at least one tapered flaring punch into a portion of a pipe so as to apply axial compressive forces to flare said portion of said pipe such that a wall thickness of said flared portion after pressing is at least 70% of a wall thickness of said pipe before pressing when a diameter of said flared portion is at least twice a diameter of said pipe before pressing.

2. A method of forming a highly flared pipe according to claim 1, wherein application of said axial compressive forces is controlled by controlling a taper angle of said flaring punch.

3. A method of forming a highly flared pipe according to claim 2, further comprising the steps of forming said flared portion by sequentially pressing a plurality of tapered flaring punches into said portion of said pipe, each punch having greater maximum diameter than a previous punch.

4. A method of forming a highly flared pipe according to claim 2, wherein said taper angle is 7 degrees.

5. A method of forming a highly flared pipe according to claim 1, further comprising the steps of forming said flared portion by sequentially pressing a plurality of tapered flaring punches into said portion of said pipe, each punch having greater maximum diameter than a previous punch.

6. A method of forming a highly flared pipe according to claim 3, wherein first, second, and third tapered flaring punches are sequentially pressed into said portion of said pipe, said first tapered flaring punch having a maximum diameter of 1.4 times said diameter of said pipe before pressing, said second tapered flaring punch having a maximum diameter of 1.2 times said maximum diameter of said first tapered flaring punch, and said third tapered flaring punch having a maximum diameter of 1.2 times said maximum diameter of said second tapered flaring punch.

7. A method of forming a highly flared pipe according to claim 3, wherein first, second, third, and fourth tapered flaring punches are sequentially pressed into said portion of said pipe, said first tapered flaring punch having a maximum diameter of 1.4 times said diameter of said pipe before pressing, said second tapered flaring punch having a maximum diameter of 1.11 times said maximum diameter of said first tapered flaring punch, said third tapered flaring punch having a maximum diameter of 1.16 times said maximum diameter of said second tapered flaring punch, and said fourth tapered flaring punch having a maximum diameter of 1.137 times said maximum diameter of said third tapered flaring punch.

8. A method of forming a highly flared pipe according to claim 1, wherein said pipe is a seam-welded pipe comprising a seam-welded region, wherein said pipe defines an axis, and wherein said at least one punch is pressed into said portion of said pipe such that said flared portion is eccentric from said axis and such that said seam welded region is aligned with a direction of maximum eccentricity.

9. A method of forming a highly flared pipe according to claim 1, wherein said pipe is a seam-welded pipe comprising a seam-welded region, wherein said pipe defines an axis, and wherein said at least one punch is pressed into said portion of said pipe such that said flared portion is eccentric from said axis and such that said seam welded region is aligned with a direction of maximum eccentricity.

10. A method of forming a highly flared pipe according to claim 1, wherein said pipe is a seam-welded pipe comprising a seam-welded region, wherein said pipe defines an axis, and wherein said at least one punch is pressed into said portion of said pipe such that said flared portion is eccentric from said axis and such that said seam welded region is aligned with a direction of maximum eccentricity.

11. A method of forming a highly flared pipe according to claim 1, wherein said pipe defines an axis, and wherein at least one punch is pressed into said portion of said pipe such that said flared portion is substantially concentric with said axis.

12. A highly flared pipe comprising a flared portion, said flared portion being formed by pressing a flaring punch into said pipe, wherein a wall thickness of said flared portion is at least 70% of a wall thickness of of said pipe other than at said flared portion when a diameter of said flared portion is at least twice a diameter of said pipe other than at said flared portion.

13. A highly flared pipe according to claim 12, wherein said pipe is a seam-welded pipe comprising a seam-welded region, wherein said pipe defines an axis, and wherein said flared portion is eccentric from said axis such that said seam welded region is aligned with a direction of maximum eccentricity.

14. A highly flared pipe according to claim 13, wherein an end of said flared portion comprises a flange.

15. A highly flared pipe according to claim 12, wherein an end of said flared portion comprises a flange.

16. A highly flared pipe according to claim 5, wherein said pipe defines an axis, and wherein said flared portion is substantially concentric with said axis.

* * * * *